US010893350B2

(12) United States Patent
Kärkkäinen et al.

(10) Patent No.: US 10,893,350 B2
(45) Date of Patent: Jan. 12, 2021

(54) THERMAL WIND SHIELD AND ASSOCIATED METHODS

(71) Applicant: Nokia Technologies Oy, Espoo (FI)

(72) Inventors: Asta Maria Kärkkäinen, Helsinki (FI); Miikka Tapani Vilermo, Siuro (FI)

(73) Assignee: Nokia Technolgies Oy, Espoo (FI)

( * ) Notice: Subject to any disclaimer, the term of this patent is extended or adjusted under 35 U.S.C. 154(b) by 199 days.

(21) Appl. No.: 16/310,962

(22) PCT Filed: Jun. 30, 2017

(86) PCT No.: PCT/FI2017/050491
§ 371 (c)(1),
(2) Date: Dec. 18, 2018

(87) PCT Pub. No.: WO2018/002444
PCT Pub. Date: Jan. 4, 2018

(65) Prior Publication Data
US 2020/0314516 A1 Oct. 1, 2020

(30) Foreign Application Priority Data
Jun. 30, 2016 (GB) ..... 1611404.3

(51) Int. Cl.
*H04R 1/08* (2006.01)
*H05B 3/14* (2006.01)
*H05B 3/34* (2006.01)

(52) U.S. Cl.
CPC ..... *H04R 1/086* (2013.01); *H05B 3/145* (2013.01); *H05B 3/34* (2013.01); *H04R 2410/07* (2013.01); *H04R 2499/11* (2013.01)

(58) Field of Classification Search
CPC . H04R 1/04; H04R 1/08; H04R 1/083; H04R 2410/00; H04R 1/07
See application file for complete search history.

(56) References Cited

U.S. PATENT DOCUMENTS 6,220,386 B1 * 4/2001 Tichy ..... A42B 3/163 181/136
8,817,971 B2 8/2014 Shida et al.
(Continued)

FOREIGN PATENT DOCUMENTS

DE 7131735 U 4/1972
EP 2107797 A1 10/2009
(Continued)

OTHER PUBLICATIONS

Bachmann et al., "The Three-Dimensional Shape of Serrations at Barn Owl Wings: Towards a Typical Natural Serration as a Role Model for Biomimetic Applications", Journal of Anatomy, 2011, pp. 192-202.

(Continued)

*Primary Examiner* — Walter F Briney, III
(74) *Attorney, Agent, or Firm* — Harrington & Smith

(57) ABSTRACT

A virtual reality apparatus comprising: at least one heat-generating virtual reality electronic component; a housing configured to contain the at least one heat-generating virtual reality electronic component; a microphone having an audio input positioned at a surface of the housing; and a plurality of elongated heat-conducting elements configured to conduct heat generated by the at least one heat-generating virtual reality electronic component from the inside of the housing to the outside of the housing, wherein the plurality of elongated heat-conducting elements protrude from the surface of the housing in proximity to the audio input of the microphone to disturb the flow of air at the surface and reduce the amount of wind noise detected by the microphone.

20 Claims, 4 Drawing Sheets

(56) References Cited

U.S. PATENT DOCUMENTS

| | | | | |
|---|---|---|---|---|
| 2002/0191802 | A1* | 12/2002 | Choe | H04R 23/00 381/92 |
| 2005/0270782 | A1 | 12/2005 | Selover | |
| 2005/0270792 | A1 | 12/2005 | Suzuki | |
| 2014/0055671 | A1 | 2/2014 | Kawamura | |
| 2014/0168507 | A1 | 6/2014 | Renaud | |
| 2014/0190676 | A1 | 7/2014 | Zhamu et al. | |
| 2014/0270273 | A1* | 9/2014 | Muza | H04R 19/005 381/174 |
| 2015/0049243 | A1 | 2/2015 | Samuels et al. | |

FOREIGN PATENT DOCUMENTS

| | | | |
|---|---|---|---|
| GB | 2499022 | A | 8/2013 |
| JP | 2015130055 | A | 7/2015 |

OTHER PUBLICATIONS

Shtein et al., "Graphene-Based Hybrid Composites for Efficient Thermal Management of Electronic Devices", ACS Applied Mater. Interfaces, vol. 7, No. 42, 2015, pp. 23725-23730.

Malekpour et al., "Thermal Conductivity of Graphene Laminate: Making Plastic Thermally Conductive", Materials Science Mesoscale and Nanoscale Physics, Jul. 5, 2014, pp. 1-26.

"A6000 Overheating During Video Recording", Dpreview, Retrieved on Dec. 13, 2018, Webpage available at : https://www.dpreview.com/forums/thread/3838499?page=3.

Search Report received for corresponding United Kingdom Patent Application No. 1611404.3, dated Aug. 12, 2018, 3 pages.

International Search Report and Written Opinion received for corresponding Patent Cooperation Treaty Application No. PCT/FI2017/050491, dated Oct. 16, 2017, 14 pages.

* cited by examiner

THERMAL WIND SHIELD AND ASSOCIATED METHODS

RELATED APPLICATION

This application was originally filed as PCT Application No. PCT/FI2017/050491 filed Jun. 30, 2017 which claims priority benefit from GB Application No. 1611404.3 filed Jun. 30, 2016.

TECHNICAL FIELD

The present disclosure relates particularly to virtual reality devices, associated methods and apparatus. Certain embodiments specifically concern a virtual reality apparatus comprising at least one heat-generating virtual reality electronic component, a housing, a microphone and a plurality of elongated heat-conducting elements. In these embodiments, the plurality of elongated heat-conducting elements are configured to conduct heat generated by the at least one heat-generating virtual reality electronic component from the inside of the housing to the outside of the housing, and protrude from the surface of the housing in proximity to an audio input of the microphone to disturb the flow of air at the surface of the housing and reduce the amount of wind noise detected by the microphone.

Some embodiments may relate to portable electronic devices, in particular, so-called hand-portable electronic devices which may be hand-held in use (although they may be placed in a cradle in use). Such hand-portable electronic devices include so-called Personal Digital Assistants (PDAs) and tablet PCs. The portable electronic devices/apparatus according to one or more disclosed example aspects/embodiments may provide one or more audio/text/video communication functions (e.g. tele-communication, video-communication, and/or text transmission, Short Message Service (SMS)/Multimedia Message Service (MMS)/emailing functions, interactive/non-interactive viewing functions (e.g. web-browsing, navigation, TV/program viewing functions), music recording/playing functions (e.g. MP3 or other format and/or (FM/AM) radio broadcast recording/playing), downloading/sending of data functions, image capture function (e.g. using a (e.g. in-built) digital camera), and gaming functions.

BACKGROUND

Research is currently being done to develop virtual reality devices.

The listing or discussion of a prior-published document or any background in this specification should not necessarily be taken as an acknowledgement that the document or background is part of the state of the art or is common general knowledge.

SUMMARY

According to a first aspect, there is provided a virtual reality apparatus comprising:

- at least one heat-generating virtual reality electronic component;
- a housing configured to contain the at least one heat-generating virtual reality electronic component;
- a microphone having an audio input positioned at a surface of the housing; and
- a plurality of elongated heat-conducting elements configured to conduct heat generated by the at least one heat-generating virtual reality electronic component from the inside of the housing to the outside of the housing,
- wherein the plurality of elongated heat-conducting elements protrude from the surface of the housing in proximity to the audio input of the microphone to disturb the flow of air at the surface and reduce the amount of wind noise detected by the microphone.

The apparatus may comprise an air flow detector for determining the direction of air flow at the surface of the housing, and one or more actuators configured to align the plurality of elongated heat-conducting elements with the predetermined direction of air flow to further reduce the amount of wind noise detected by the microphone.

The air flow detector may be configured to determine the direction of air flow based on the low-frequency content of the wind noise detected by two or more spaced apart microphones.

The plurality of elongated heat-conducting elements may comprise first and second metals having different respective coefficients of thermal expansion, and the one or more actuators may be configured to control the temperature of the elongated heat-conducting elements to deflect the elongated heat-conducting elements in the predetermined direction.

The plurality of elongated heat-conducting elements may comprise a magnetic material, and the one or more actuators may be configured to provide a magnetic field which interacts with the magnetic material to deflect the elongated heat-conducting elements in the predetermined direction.

The plurality of elongated heat-conducting elements may comprise a dielectric material, and the one or more actuators may be configured to provide an electric field which interacts with the dielectric material to deflect the elongated heat-conducting elements in the predetermined direction.

The apparatus may comprise one or more actuators configured to rearrange the plurality of elongated heat-conducting elements such that they mimic the shape of an owl's wing to further reduce the amount of wind noise detected by the microphone.

The apparatus may comprise a video camera having a variable field-of-view, a detector for determining the field-of-view of the video camera, and one or more actuators configured to orient the plurality of elongated heat-conducting elements such that they do not obscure the predetermined field-of-view.

The apparatus may comprise a video camera having a fixed field-of-view, and the plurality of elongated heat-conducting elements may be one or more of positioned and rigidly oriented such that they do not obscure the fixed field-of-view of the video camera.

The apparatus may comprise a video camera focused at infinity and having a fixed or variable field-of-view, and the plurality of elongated heat-conducting elements may be sufficiently transparent that they are virtually invisible to the video camera when they obscure the fixed or variable field-of-view.

The plurality of elongated heat-conducting elements may comprise a serrated edge configured to further disturb the flow of air at the surface of the housing and reduce the amount of wind noise detected by the microphone.

The plurality of elongated heat-conducting elements may be arranged such that the serrated edge of a first subset of the elongated heat-conducting elements is oriented in one direction and the serrated edge of a second subset of the elongated heat-conducting elements is oriented in a different direction.

The serrated edge may extend continuously around the external surface of the elongated heat-conducting elements.

The apparatus may comprise a plurality of elongated noise-reducing elements interspersed with the plurality of elongated heat-conducting elements to further disturb the flow of air at the surface of the housing.

The plurality of elongated noise-reducing elements may be formed from the same material as the plurality of elongated heat-conducting elements.

The plurality of elongated noise-reducing elements and the plurality of elongated heat-conducting elements may be substantially flexible.

The plurality of elongated noise-reducing elements and the plurality of elongated heat-conducting elements may be sufficiently rigid and spaced apart from one another to prevent contact therebetween regardless of the air flow at the surface of the housing.

The plurality of elongated heat-conducting elements may extend from the at least one heat-generating virtual reality electronic component to the outside of the housing.

The apparatus may comprise a heatsink within the housing configured to receive heat generated by the at least one heat-generating virtual reality electronic component, and the plurality of elongated heat-conducting elements may extend from the heatsink to the outside of the housing.

The plurality of elongated heat-conducting elements may comprise one or more of the following heat-conducting materials: a metal, an alloy, copper, graphene, a copper-graphene composite and carbon nanotubes.

The plurality of elongated heat-conducting elements may comprise a heat pipe, the heat pipe comprising a hollow tube containing a heat transfer fluid configured to change phase on absorption of heat generated by the at least one heat-generating virtual reality electronic component.

The at least one heat-generating virtual reality electronic component may comprise one or more of a video camera sensor and a processor for processing image data captured by the video camera sensor.

The virtual reality apparatus may be one or more of an electronic device, a portable electronic device, a portable telecommunications device, a mobile phone, a personal digital assistant, a tablet, a phablet, a desktop computer, a laptop computer, a server, a smartphone, a smartwatch, smart eyewear, a virtual reality device, and a module for one or more of the same.

The above statements made in respect of the plurality of elongated heat-conducting elements may apply to some or all of the elongated heat-conducting elements. Therefore, the specific configuration (e.g. materials, spacing, orientation and/or rigidity) of some elongated heat-conducting elements may or may not be different to the specific configuration of other elongated heat-conducting elements. The same applies to the plurality of elongated noise-reducing elements.

According to a further aspect, there is provided a method of assembling a virtual reality apparatus, the virtual reality apparatus comprising at least one heat-generating virtual reality electronic component, a housing configured to contain the at least one heat-generating virtual reality electronic component, a microphone having an audio input positioned at a surface of the housing, and a plurality of elongated heat-conducting elements configured to conduct heat generated by the at least one heat-generating virtual reality electronic component from the inside of the housing to the outside of the housing, the method comprising arranging the plurality of elongated heat-conducting elements such that they protrude from the surface of the housing in proximity to the audio input of the microphone to disturb the flow of air at the surface and reduce the amount of wind noise detected by the microphone.

According to a further aspect, there is provided a method of using a virtual reality apparatus, the virtual reality apparatus comprising at least one heat-generating virtual reality electronic component, a housing configured to contain the at least one heat-generating virtual reality electronic component, a microphone having an audio input positioned at a surface of the housing, a plurality of elongated heat-conducting elements configured to conduct heat generated by the at least one heat-generating virtual reality electronic component from the inside of the housing to the outside of the housing, the plurality of elongated heat-conducting elements protruding from the surface of the housing in proximity to the audio input of the microphone to disturb the flow of air at the surface and reduce the amount of wind noise detected by the microphone, and one or more actuators configured to enable the orientation of the plurality of elongated heat-conducting elements to be varied, the method comprising controlling the orientation of the plurality of elongated heat-conducting elements using the one or more actuators to at least one of further reduce the amount of wind noise detected by the microphone and prevent the plurality of elongated heat-conducting elements from obscuring the field-of-view of a video camera of the virtual reality apparatus.

The steps of any method disclosed herein do not have to be performed in the exact order disclosed, unless explicitly stated or understood by the skilled person.

Corresponding computer programs for implementing one or more steps of the methods disclosed herein are also within the present disclosure and are encompassed by one or more of the described example embodiments.

One or more of the computer programs may, when run on a computer, cause the computer to configure any apparatus, including a battery, circuit, controller, or device disclosed herein or perform any method disclosed herein. One or more of the computer programs may be software implementations, and the computer may be considered as any appropriate hardware, including a digital signal processor, a microcontroller, and an implementation in read only memory (ROM), erasable programmable read only memory (EPROM) or electronically erasable programmable read only memory (EEPROM), as non-limiting examples. The software may be an assembly program.

One or more of the computer programs may be provided on a computer readable medium, which may be a physical computer readable medium such as a disc or a memory device, or may be embodied as a transient signal. Such a transient signal may be a network download, including an internet download.

The present disclosure includes one or more corresponding aspects, example embodiments or features in isolation or in various combinations whether or not specifically stated (including claimed) in that combination or in isolation. Corresponding means for performing one or more of the discussed functions are also within the present disclosure.

The above summary is intended to be merely exemplary and non-limiting.

BRIEF DESCRIPTION OF THE FIGURES

A description is now given, by way of example only, with reference to the accompanying drawings, in which.

DESCRIPTION OF SPECIFIC ASPECTS/EMBODIMENTS

Virtual reality devices typically comprise at least one video camera, microphone, processor, battery and memory contained within a housing, and in some cases, may comprise a plurality of video cameras and microphones to enable 360° video and audio capture. The processing power required to control such devices causes a significant amount of heat to be generated inside the housing. Whilst a fan could be used to cool the device during operation, the resulting wind noise can reduce the audio quality of the microphone signals. In addition, Peltier elements require power and therefore generate further heat, whilst ventilation holes can reduce the sensitivity of the microphone(s) at resonant frequencies (peaks and troughs in the frequency response curve correspond to amplification and attenuation of sound).

The wind noise produced by air flow at the surface of the housing can also cause intolerable disturbances to the microphone signals. Furthermore, since traditional wind shields (such as "blimps" and "dead cats") can block the field-of-view of the video cameras, they are often unsuitable for use with virtual reality devices.

There will now be described an apparatus and associated methods that may address the above-mentioned issues.

Figure 1:
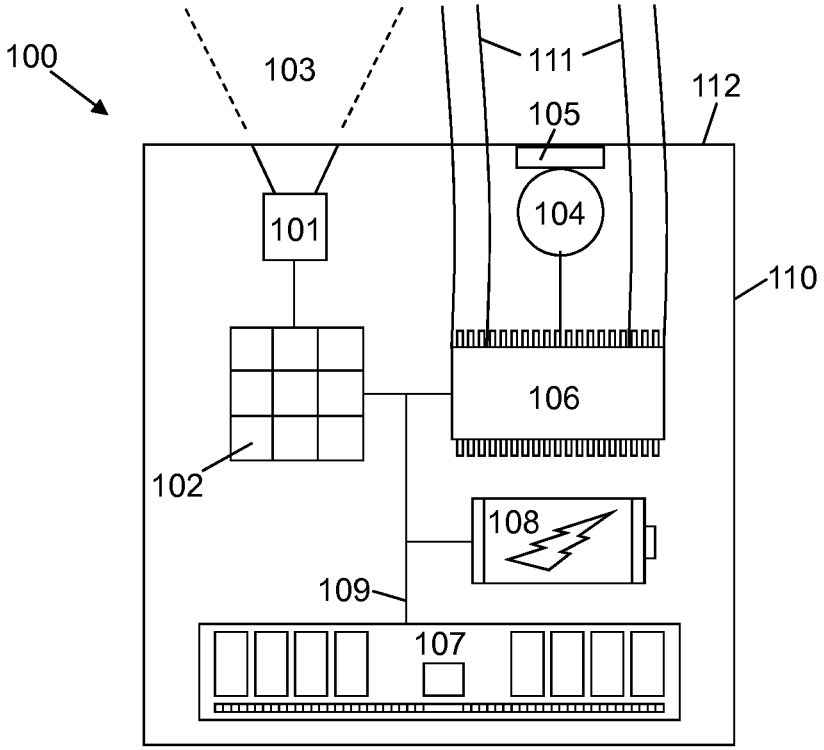
FIG. 1 shows an example of a virtual reality apparatus comprising a plurality of elongated heat-conducting elements.

FIG. 1 shows one example of a virtual reality apparatus 100. The apparatus 100 comprises a video camera 101 comprising a sensor 102 for capturing image data from within a field-of-view 103, a microphone 104 comprising an audio input 105 for capturing audio data, a processor 106, a storage medium 107, and a power supply 108. The various components are electrically connected to one another by a data bus 109 and are contained within a housing 110. In some cases, the apparatus 100 may comprise a plurality of video cameras 101 and microphones 104 (e.g. to enable 360° video/audio capture).

The apparatus 100 may be one or more of an electronic device, a portable electronic device, a portable telecommunications device, a mobile phone, a personal digital assistant, a tablet, a phablet, a desktop computer, a laptop computer, a server, a smartphone, a smartwatch, smart eyewear, a virtual reality device and a module for one or more of the same.

The processor 106 is configured for general operation of the apparatus 100 by providing signaling to, and receiving signaling from, the other components to manage their operation. The storage medium 107 is configured to store computer code configured to perform, control or enable operation of the apparatus 100. The storage medium 107 may also be configured to store settings for the other components. The processor 106 may access the storage medium 107 to retrieve the component settings in order to manage the operation of the other components. In particular, the processor 106 is configured to process the image and audio data captured respectively by the video camera 101 and microphone 104, and the storage medium 107 is configured to store the same. In addition, the power supply 108 is configured to provide electrical power to each of the components to enable their operation.

The processor 106 may be a microprocessor, including an Application Specific Integrated Circuit (ASIC). The storage medium 107 may be a temporary storage medium such as a volatile random access memory. On the other hand, the storage medium 107 may be a permanent storage medium such as a hard disk drive, a flash memory, or a non-volatile random access memory. The power supply 108 may comprise one or more of a mains supply, a primary battery, a secondary battery, a capacitor, a supercapacitor and a battery-capacitor hybrid.

As shown in FIG. 1, the virtual reality apparatus 100 comprises at least one heat-generating virtual reality electronic component (in this case the processor 106, but it could additionally or alternatively be the sensor 102 of the video camera 101), and a plurality of elongated heat-conducting elements 111 configured to conduct heat generated by the at least one heat-generating virtual reality electronic component 106 from the inside of the housing 110 to the outside of the housing 110. Furthermore, the audio input 105 of the microphone 104 is positioned at a surface 112 of the housing 110, and the plurality of elongated heat-conducting elements 111 protrude from the surface 112 of the housing 110 in proximity to the audio input 105 of the microphone 104 to disturb the flow of air at the surface 112 and reduce the amount of wind noise detected by the microphone 104.

The plurality of elongated heat-conducting elements 111 therefore serve to extract the heat generated by the at least one heat-generating virtual reality electronic component 106 from the housing as well as reducing wind noise at the surface 112 of the housing 110. The reduction in wind noise is achieved by breaking up the flowing air into smaller micro-turbulences. The use of elongated heat-conducting elements 111 for cooling purposes instead of an internal fan also avoids additional wind noise from the fan.

Figure 2:
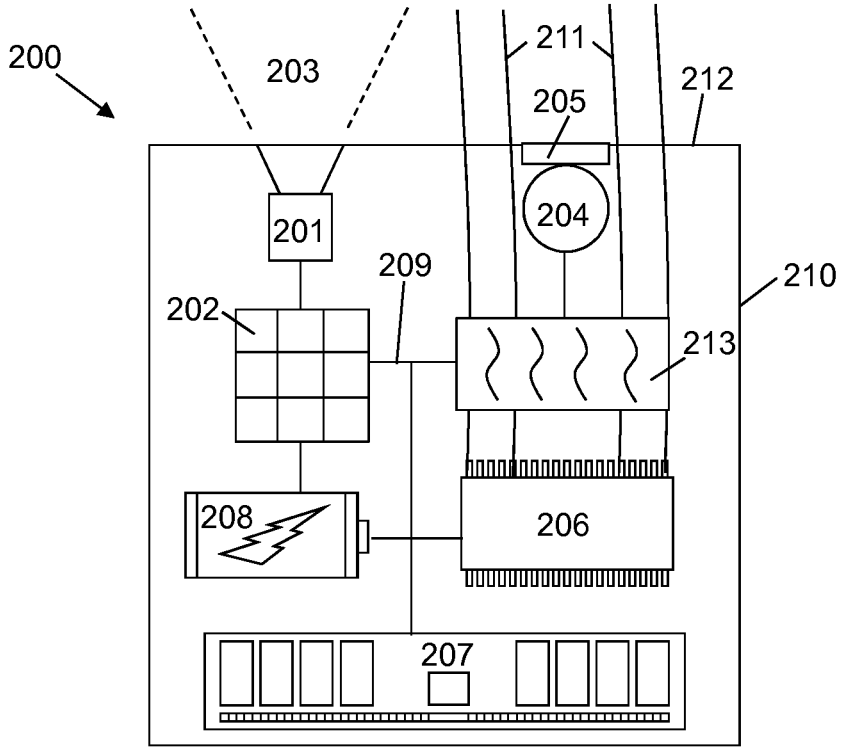
FIG. 2 shows an example of a virtual reality apparatus comprising a plurality of elongated heat-conducting elements and a heatsink.

FIG. 2 shows another example of a virtual reality apparatus 200. In this example, the apparatus 200 further comprises a heatsink 213 within the housing 210 configured to receive heat generated by the at least one heat-generating virtual reality electronic component 206. Unlike the example of FIG. 1 in which the plurality of elongated heat-conducting elements 111 extend from the at least one heat-generating virtual reality electronic component 106 to the outside of the housing 110, the plurality of elongated heat-conducting elements 211 in this example extend from the heatsink 213 to the outside of the housing 210. The heatsink 213 therefore serves as an intermediary cooling component to which the elongated heat-conducting elements 211 are attached. This arrangement may be particularly useful in scenarios where it is difficult or impractical to attach the elongated heat-conducting elements 211 directly to the at least one heat-generating virtual reality electronic component 206 (e.g. the sensor of the video camera).

Figure 3:
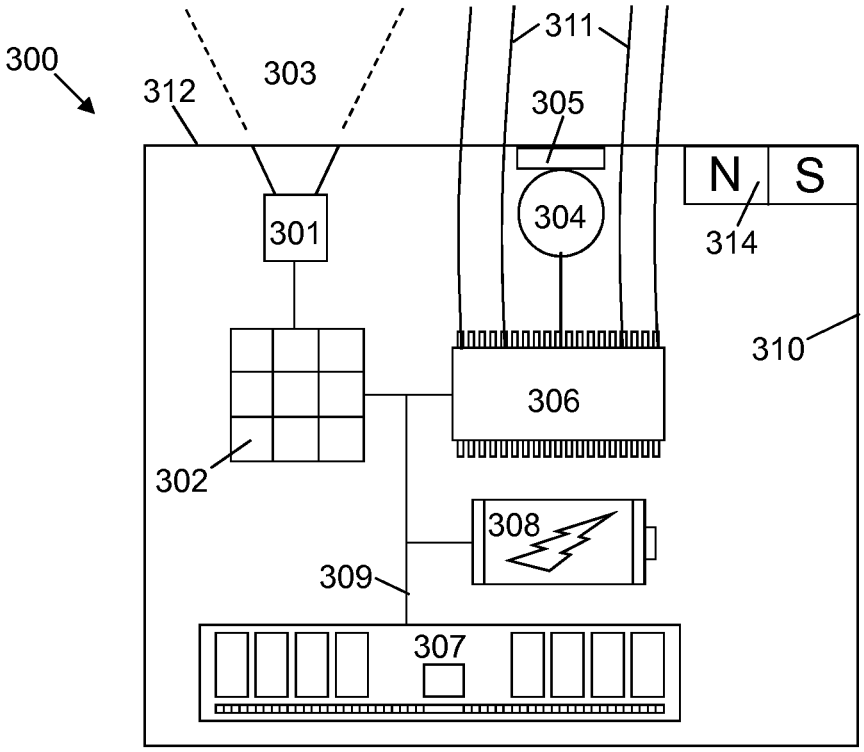
FIG. 3 shows an example of a virtual reality apparatus comprising a plurality of elongated heat-conducting elements and an actuator.

FIG. 3 shows another example of a virtual reality apparatus 300. In this example, the apparatus 300 comprises one or more actuators 314 configured to control the orientation of the plurality of elongated heat-conducting elements 311. To achieve this, the plurality of elongated heat-conducting elements 311 may comprise a magnetic material, and the one or more actuators 314 may be configured to provide a magnetic field which interacts with the magnetic material to deflect the elongated heat-conducting elements 311 in a particular direction. In another example, the plurality of elongated heat-conducting elements 311 may comprise a dielectric material, and the one or more actuators 314 may be configured to provide an electric field which interacts with the dielectric material to deflect the elongated heat-conducting elements 311 in a particular direction. In a further example, the plurality of elongated heat-conducting elements 311 may comprise first and second metals having different respective coefficients of thermal expansion (i.e. the first and second metals form a bimetallic strip), and the one or more actuators 314 may be configured to control the temperature of the elongated heat-conducting elements 311 to deflect the elongated heat-conducting elements 311 in a particular direction.

As shown in FIG. 3, the ability to control the orientation of the elongated heat-conducting elements 311 may be used to prevent the elongated heat-conducting elements 311 from obscuring the field-of-view 303 of the video camera 301. This may be advantageous, for example, if the video camera 301 has a variable field-of-view 303 which needs to be kept clear at all times. In this scenario, the apparatus 300 may further comprise a detector (not shown) for determining the field-of-view 303 of the video camera 301, and the one or more actuators 314 may be controlled based on the predetermined field-of-view 303. In examples where the field-of-view 303 of the video camera 301 is fixed, however, the one or more actuators 314 may not be required. Instead, the plurality of elongated heat-conducting elements 311 may be one or more of positioned and rigidly oriented such that they do not obscure the fixed field-of-view 303. Furthermore, regardless of whether the field-of-view 303 of the video camera 301 is fixed or variable, the plurality of elongated heat-conducting elements 311 may be sufficiently transparent that they are virtually invisible to the video camera 301 when they obscure the fixed or variable field-of-view 303. The use of transparent materials has been found to be most effective when the video camera 301 is focused at infinity (as is most often the case with virtual reality cameras).

The ability to control the orientation of the elongated heat-conducting elements 311 can also be used to further reduce the amount of wind noise detected by the microphone 304. In order to achieve this, the apparatus 300 may comprise an air flow detector for determining the direction of air flow at the surface 312 of the housing 310, and the one or more actuators 314 may be configured to align the plurality of elongated heat-conducting elements 311 with the predetermined direction of air flow (i.e. such that the ends of the elongated heat-conducting elements 311 point in the direction of air flow). Given that wind noise tends to comprise lower frequencies than the audio signal of interest, the air flow detector may be configured to determine the direction of air flow based on the low-frequency content of the wind noise detected by two or more spaced apart microphones. The two or more spaced apart microphones may comprise microphone 304 and at least one further microphone (e.g. at least one separate dedicated microphone). On the other hand, the two or more spaced apart microphones may comprise at least two further microphones (i.e. not including microphone 304). In some cases, however, the elongated heat-conducting elements 311 may be substantially flexible that they align themselves with the direction of air flow naturally. In this scenario, the actuators 314 may not be required.

In some examples, the actuators 314 may be configured to rearrange the plurality of elongated heat-conducting elements 311 such that they mimic the shape of an owl's wing to further reduce the amount of wind noise detected by the microphone 304. Owls are known to be silent flyers. The quietness of their flight is owed to the structure and arrangement of their feathers.

Figure 4A:
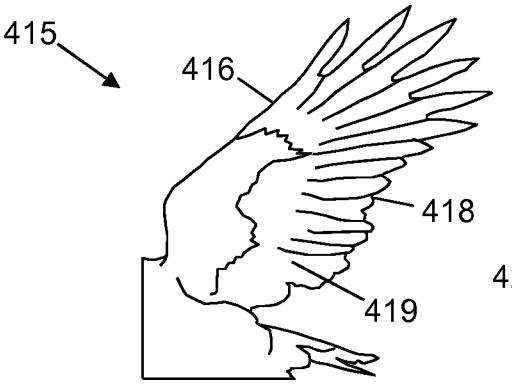
FIGS. 4*a-b* show how the structure of an owl's wing reduces wind noise.
Figure 4B:
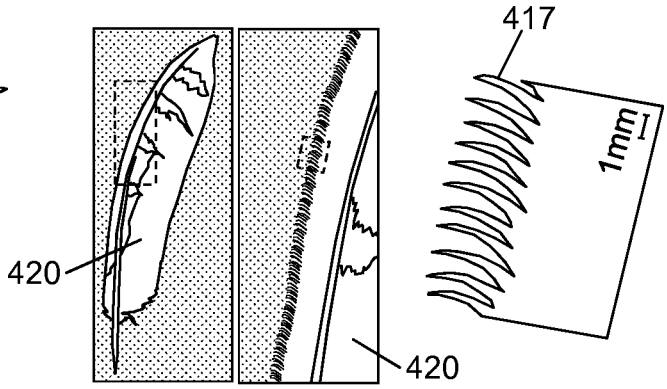

FIGS. 4*a* and 4*b* show the structure and arrangement of an owl's wing 415. The leading edge 416 of an owl's wing 415 (i.e. the edge 416 which faces towards the wind) has feathers 420 covered in serrations 417 which break up the flowing air into smaller micro-turbulences. These smaller areas of turbulence then roll over the owl's wing 415 towards the trailing edge 418 of the wing 415 which comprises a flexible fringe 419. The flexible fringe 419 breaks up the air further. In addition, the feathers 420 of an owl's wing 415 are relatively soft to absorb high frequency sound. This combination of features reduces the sound of the wind on the owl's wings 415 as it flies through the air.

In order to help recreate the noise-reducing effect of an owl's wing 415, the plurality of elongated heat-conducting elements may comprise a serrated edge similar to the feathers 420 at the leading edge 416 of the owl's wing 415.

Figure 5A:
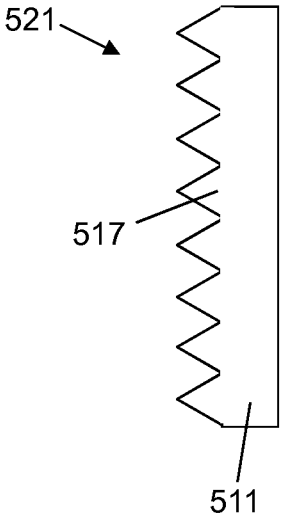
FIGS. 5*a-c* show examples of elongated heat-conducting elements comprising a serrated edge.
Figure 5B:
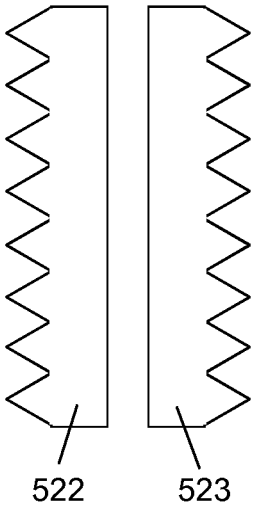
Figure 5C:
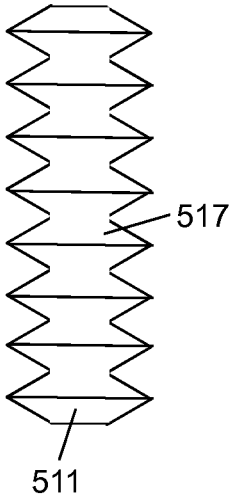

FIG. 5*a* shows an elongated heat-conducting element 511 (in cross-section) comprising a serrated edge 521 configured to further disturb the flow of air at the surface of the housing and reduce the amount of wind noise detected by the microphone. In some cases, as shown in FIG. 5*b*, the plurality of elongated heat-conducting elements 511 may be arranged such that the serrated edge 521 of a first subset 522 of the elongated heat-conducting elements 511 is oriented in one direction and the serrated edge 521 of a second subset 523 of the elongated heat-conducting elements 511 is oriented in a different direction. This may be particularly useful in examples where the apparatus does not comprise one or more actuators configured to control the orientation of the elongated heat-conducting elements 511 (and therefore cannot orient the elongated heat-conducting elements 511 such that the serrations 517 are directed into the wind). In this scenario, the different fixed orientations of the serrated edges 521 mean that there is a chance that the serrations 517 of some of the elongated heat-conducting elements 511 will be correctly oriented for a given wind direction. In other cases, the serrated edge 521 may extend continuously around the external surface of the elongated heat-conducting elements 511, as shown in FIG. 5*c*. This configuration further helps to ensure that the serrations 517 are suitably aligned with the wind direction even when the apparatus does not comprise actuators to control the orientation of the elongated heat-conducting elements 511.

Figure 6:
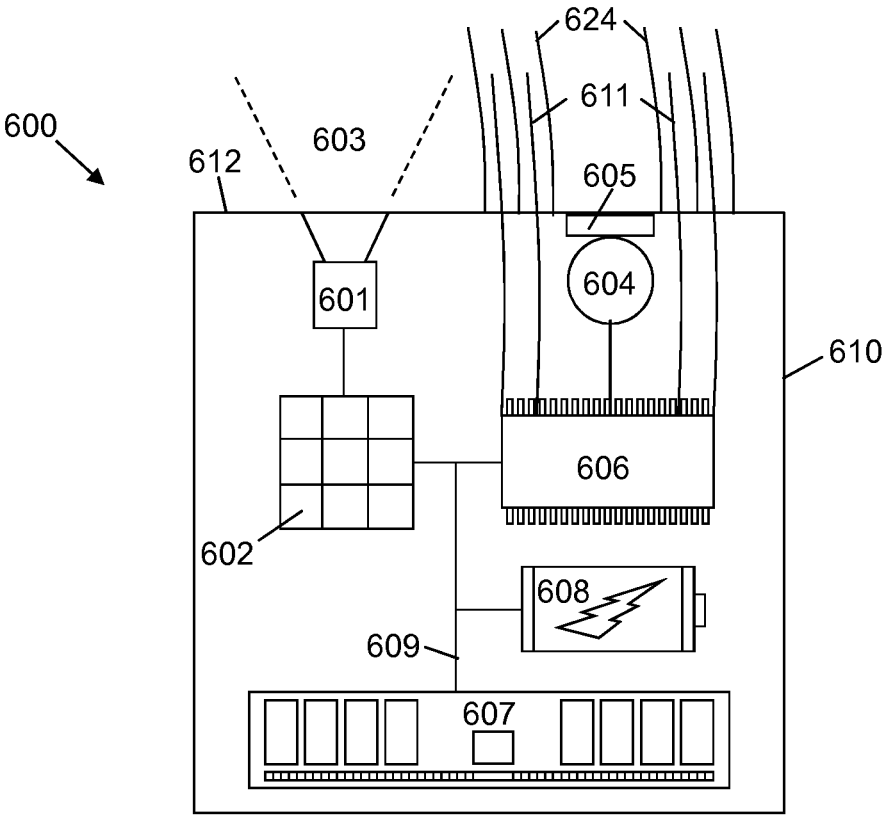
FIG. 6 shows an example of a virtual reality apparatus comprising a plurality of elongated heat-conducting elements and a plurality of elongated noise-reducing elements.

FIG. 6 shows another example of a virtual reality apparatus 600. In this example, the apparatus 600 comprises a plurality of elongated noise-reducing elements 624 interspersed with the plurality of elongated heat-conducting elements 611 to further disturb the flow of air at the surface 612 of the housing 610. As shown, the plurality of elongated noise-reducing elements 624 are attached to the surface 612 of the housing 610 in proximity to the audio input 605 of the microphone 604 (similar to the strands of fur on a "dead cat" wind shield), and help to attenuate wind noise created by air circulating around the plurality of elongated heat-conducting elements 611.

The plurality of elongated noise-reducing elements 624 may or may not be formed from the same material as the plurality of elongated heat-conducting elements 611. In some cases, both the noise-reducing elements 624 and the heat-conducting elements 611 may be substantially flexible. In other cases, however, both the noise-reducing elements 624 and the heat-conducting elements 611 may be sufficiently rigid and spaced apart from one another to prevent contact therebetween regardless of the air flow at the surface 612 of the housing 610. This feature helps to reduce the noise caused by flexible elements 624 colliding with more rigid adjacent elements 611 when exposed to the wind.

In practice, the plurality of elongated heat-conducting elements 611 may comprise one or more of the following heat-conducting materials: a metal, an alloy, copper, graphene, a copper-graphene composite and carbon nanotubes. For example, the elongated heat-conducting elements 611 may be formed from copper or copper-graphene wires, or from one or more of graphene flakes and carbon nanotubes coated in transparent plastic. Also, as mentioned previously, the plurality of elongated heat-conducting elements 611 may additionally or alternatively comprise bimetals, magnetic materials or dielectric materials.

In some cases, the plurality of elongated heat-conducting elements 611 may comprise a heat-pipe (not shown). A heat pipe comprises a hollow tube containing a heat transfer fluid configured to change phase on absorption of heat. Typically, the fluid is a liquid which evaporates at one end of the heat pipe and travels as a gas to the other (cooler) end where it condenses back into a liquid. The liquid then returns to the hot end of the tube by gravity or capillary action and repeats the cycle. In these cases, the heat pipe may protrude from the housing 610 of the apparatus 600 to disturb the flow of air at the surface 612, or it may be contained within the housing 610 and attached to a separate piece of heat-conducting material which protrudes from the housing 610.

The plurality of elongated noise-reducing elements may comprise any materials from which the heat-conducting elements are made. On the other hand, they could be made from natural or synthetic fibres used in textiles.

Figure 7:
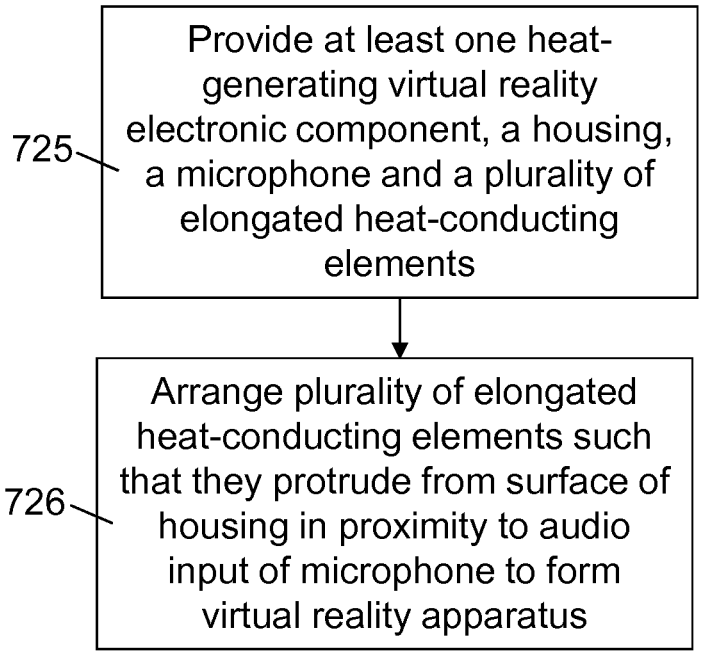
FIG. 7 shows a method of assembling a virtual reality apparatus.

FIG. 7 shows schematically the main steps 725-726 of a method of assembling a virtual reality apparatus. The method generally comprises: providing at least one heat-generating virtual reality electronic component, a housing, a microphone and a plurality of elongated heat-conducting elements 725; and arranging the plurality of elongated heat-conducting elements such that they protrude from the surface of the housing in proximity to the audio input of the microphone to form the virtual reality apparatus 726.

Figure 8:
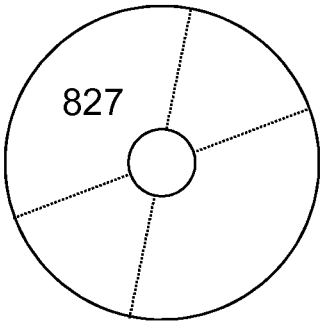
FIG. 8 shows a computer-readable medium comprising a computer program configured to perform, control or enable a method described herein.

FIG. 8 illustrates schematically a computer/processor readable medium 827 providing a computer program according to one embodiment. The computer program may comprise computer code configured to perform, control or enable one or more of the method steps 725-726 of FIG. 7. In this example, the computer/processor readable medium 827 is a disc such as a digital versatile disc (DVD) or a compact disc (CD). In other embodiments, the computer/processor readable medium 827 may be any medium that has been programmed in such a way as to carry out an inventive function. The computer/processor readable medium 827 may be a removable memory device such as a memory stick or memory card (SD, mini SD, micro SD or nano SD).

Other embodiments depicted in the figures have been provided with reference numerals that correspond to similar features of earlier described embodiments. For example, feature number 1 can also correspond to numbers 101, 201, 301 etc. These numbered features may appear in the figures but may not have been directly referred to within the description of these particular embodiments. These have still been provided in the figures to aid understanding of the further embodiments, particularly in relation to the features of similar earlier described embodiments.

It will be appreciated to the skilled reader that any mentioned apparatus/device and/or other features of particular mentioned apparatus/device may be provided by apparatus arranged such that they become configured to carry out the desired operations only when enabled, e.g. switched on, or the like. In such cases, they may not necessarily have the appropriate software loaded into the active memory in the non-enabled (e.g. switched off state) and only load the appropriate software in the enabled (e.g. on state). The apparatus may comprise hardware circuitry and/or firmware. The apparatus may comprise software loaded onto memory. Such software/computer programs may be recorded on the same memory/processor/functional units and/or on one or more memories/processors/functional units.

In some embodiments, a particular mentioned apparatus/device may be pre-programmed with the appropriate software to carry out desired operations, and wherein the appropriate software can be enabled for use by a user downloading a "key", for example, to unlock/enable the software and its associated functionality. Advantages associated with such embodiments can include a reduced requirement to download data when further functionality is required for a device, and this can be useful in examples where a device is perceived to have sufficient capacity to store such pre-programmed software for functionality that may not be enabled by a user.

It will be appreciated that any mentioned apparatus/circuitry/elements/processor may have other functions in addition to the mentioned functions, and that these functions may be performed by the same apparatus/circuitry/elements/processor. One or more disclosed aspects may encompass the electronic distribution of associated computer programs and computer programs (which may be source/transport encoded) recorded on an appropriate carrier (e.g. memory, signal).

It will be appreciated that any "computer" described herein can comprise a collection of one or more individual processors/processing elements that may or may not be located on the same circuit board, or the same region/position of a circuit board or even the same device. In some embodiments one or more of any mentioned processors may be distributed over a plurality of devices. The same or different processor/processing elements may perform one or more functions described herein.

It will be appreciated that the term "signaling" may refer to one or more signals transmitted as a series of transmitted and/or received signals. The series of signals may comprise one, two, three, four or even more individual signal components or distinct signals to make up said signaling. Some or all of these individual signals may be transmitted/received simultaneously, in sequence, and/or such that they temporally overlap one another.

With reference to any discussion of any mentioned computer and/or processor and memory (e.g. including ROM, CD-ROM etc), these may comprise a computer processor, Application Specific Integrated Circuit (ASIC), field-programmable gate array (FPGA), and/or other hardware components that have been programmed in such a way to carry out the inventive function.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

While there have been shown and described and pointed out fundamental novel features as applied to different embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment may be incorporated in any other disclosed or described or suggested form or embodiment as a general matter of design choice. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

The invention claimed is:

1. An apparatus comprising:

at least one heat-generating electronic component;

a housing configured to contain the at least one heat-generating electronic component;

a microphone having an audio input positioned at a surface of the housing; and a plurality of elongated heat-conducting elements configured to conduct heat generated by the at least one heat-generating electronic component from the inside of the housing to the outside of the housing, wherein the plurality of elongated heat-conducting elements protrude from the surface of the housing in proximity to the audio input of the microphone to disturb the flow of air at the surface and reduce the amount of wind noise detected by the microphone.

2. The apparatus of claim 1, wherein the apparatus comprises an air flow detector for determining the direction of air flow at the surface of the housing, and one or more actuators configured to align the plurality of elongated heat-conducting elements with the predetermined direction of air flow to further reduce the amount of wind noise detected by the microphone.

3. The apparatus of claim 2, wherein the air flow detector is configured to determine the direction of air flow based on the low-frequency content of the wind noise detected by two or more spaced apart microphones.

4. The apparatus of claim 2, wherein the plurality of elongated heat-conducting elements comprise first and second metals having different respective coefficients of thermal expansion, and wherein the one or more actuators are configured to control the temperature of the elongated heat-conducting elements to deflect the elongated heat-conducting elements in the predetermined direction.

5. The apparatus of claim 2, wherein the plurality of elongated heat-conducting elements comprise a magnetic material, and wherein the one or more actuators are configured to provide a magnetic field which interacts with the magnetic material to deflect the elongated heat-conducting elements in the predetermined direction.

6. The apparatus of claim 2, wherein the plurality of elongated heat-conducting elements comprise a dielectric material, and wherein the one or more actuators are configured to provide an electric field which interacts with the dielectric material to deflect the elongated heat-conducting elements in the predetermined direction.

7. The apparatus of claim 1, wherein the apparatus comprises one or more actuators configured to rearrange the plurality of elongated heat-conducting elements such that they mimic the shape of an owl's wing to further reduce the amount of wind noise detected by the microphone.

8. The apparatus of claim 1, wherein the apparatus comprises a video camera having a variable field-of-view, a detector for determining the field-of-view of the video camera, and one or more actuators configured to orient the plurality of elongated heat-conducting elements such that they do not obscure the predetermined field-of-view.

9. The apparatus of claim 1, wherein the apparatus comprises a video camera having a fixed field of view, and wherein the plurality of elongated heat-conducting elements are one or more of positioned and rigidly oriented such that they do not obscure the fixed field-of-view of the video camera.

10. The apparatus of claim 1, wherein the apparatus comprises a video camera focused at infinity and having a fixed or variable field-of-view, and wherein the plurality of elongated heat-conducting elements are sufficiently transparent that they are virtually invisible to the video camera when they obscure the fixed or variable field-of-view.

11. The apparatus of claim 1, wherein the plurality of elongated heat-conducting elements comprise a serrated edge configured to further disturb the flow of air at the surface of the housing and reduce the amount of wind noise detected by the microphone;

wherein the plurality of elongated heat-conducting elements are arranged such that the serrated edge of a first subset of the elongated heat-conducting elements is oriented in one direction and the serrated edge of a second subset of the elongated heat-conducting elements is oriented in a different direction.

12. The apparatus of claim 1, wherein the apparatus comprises a plurality of elongated noise-reducing elements interspersed with the plurality of elongated heat-conducting elements to further disturb the flow of air at the surface of the housing.

13. The apparatus of claim 12, wherein the plurality of elongated noise-reducing elements are formed from the same material as the plurality of elongated heat-conducting elements.

14. The apparatus of claim 12, wherein the plurality of elongated noise-reducing elements and the plurality of elongated heat-conducting elements are substantially flexible.

15. The apparatus of claim 12, wherein the plurality of elongated noise-reducing elements and the plurality of elongated heat-conducting elements are sufficiently rigid and spaced apart from one another to prevent contact therebetween regardless of the air flow at the surface of the housing.

16. The apparatus of claim 1, wherein the plurality of elongated heat-conducting elements extend from the at least one heat-generating electronic component to the outside of the housing.

17. The apparatus of claim 1, wherein the apparatus comprises a heatsink within the housing configured to receive heat generated by the at least one heat-generating electronic component, and wherein the plurality of elongated heat-conducting elements extend from the heatsink to the outside of the housing.

18. The apparatus of claim 1, wherein the plurality of elongated heat-conducting elements comprise one or more of the following heat-conducting materials: a metal, an alloy, copper, graphene, a copper-graphene composite and carbon nanotubes.

19. The apparatus of claim 1, wherein the plurality of elongated heat-conducting elements comprise a heat pipe, the heat pipe comprising a hollow tube containing a heat transfer fluid configured to change phase on absorption of heat generated by the at least one heat-generating electronic component.

20. A non-transitory computer readable medium comprising program instructions for causing the apparatus of claim 1 to perform at least the following:

controlling the orientation of the plurality of elongated heat-conducting elements using the one or more actuators to at least one of:

further reduce the amount of wind noise detected by the microphone, or prevent the plurality of elongated heat-conducting elements from obscuring the field-of-view of a video camera of the apparatus.

* * * * *